US009396620B2

(12) United States Patent
Takayama et al.

(10) Patent No.: US 9,396,620 B2
(45) Date of Patent: Jul. 19, 2016

(54) MONEY HANDLING MACHINE, MONEY HANDLING SYSTEM, MONEY HANDLING METHOD AND VALUABLE-MEDIUM HANDLING MACHINE

(75) Inventors: Atsushi Takayama, Tokyo (JP); Yasutaka Toyoda, Tokyo (JP); Keita Ito, Tokyo (JP)

(73) Assignee: GLORY LTD., Himeji-shi, Hyogo-ken (JP)

( * ) Notice: Subject to any disclaimer, the term of this patent is extended or adjusted under 35 U.S.C. 154(b) by 0 days.

(21) Appl. No.: 14/241,454

(22) PCT Filed: Jul. 24, 2012

(86) PCT No.: PCT/JP2012/068701

§ 371 (c)(1),
(2), (4) Date: Feb. 27, 2014

(87) PCT Pub. No.: WO2013/031433

PCT Pub. Date: Mar. 7, 2013

(65) Prior Publication Data

US 2014/0224614 A1 Aug. 14, 2014

(30) Foreign Application Priority Data

Aug. 30, 2011 (JP) ..... 2011-187154
Jun. 15, 2012 (JP) ..... 2012-135837

(51) Int. Cl.
*G07F 7/04* (2006.01)
*G07F 19/00* (2006.01)
*G07D 11/00* (2006.01)

(52) U.S. Cl.
CPC ..... *G07F 19/202* (2013.01); *G07D 11/009* (2013.01); *G07D 11/0072* (2013.01); *G07D 11/0075* (2013.01); *G07D 11/0096* (2013.01)

(58) Field of Classification Search
CPC . G07D 7/00; G07D 11/0021; G07D 11/0096; G07F 7/04; G07F 19/202; G07F 19/204
USPC ..... 194/206, 207, 217; 209/534; 235/379
See application file for complete search history.

(56) References Cited

U.S. PATENT DOCUMENTS 5,918,748 A 7/1999 Clark et al.
6,067,530 A * 5/2000 Brooks et al. ..... 705/30

(Continued)

FOREIGN PATENT DOCUMENTS

GB 2 369 914 A 6/2002
JP 6-103292 4/1994

(Continued)

OTHER PUBLICATIONS

Partial European Search Report (Application No. 12828278.7—PCT/JP2012/068701) (7 pages—dated Apr. 11, 2015).

(Continued)

*Primary Examiner* — Mark Beauchaine
(74) *Attorney, Agent, or Firm* — Renner, Kenner, Greive Bobak, Taylor & Weber

(57) ABSTRACT

In a money handling machine 1, information related to a valuable medium to be stored in a storing unit 70 is inputted through an input unit 5. A control unit 50 of the money handling machine 1 transmits, to an external apparatus 200, a money recognition result by a recognition unit 40 and information related to a valuable medium having been inputted through the input unit 5.

12 Claims, 11 Drawing Sheets

(56) References Cited

U.S. PATENT DOCUMENTS

| | | | | |
|---|---|---|---|---|
| 7,637,422 | B2 | 12/2009 | Kwak et al. | |
| 2005/0060055 | A1 * | 3/2005 | Hallowell et al. | 700/95 |
| 2009/0087076 | A1 | 4/2009 | Jenrick et al. | |

FOREIGN PATENT DOCUMENTS

| | | | |
|---|---|---|---|
| JP | 2002-170145 | | 6/2002 |
| JP | 3542051 | | 7/2004 |
| JP | 3711068 | | 10/2005 |
| JP | 2006-11900 | A | 1/2006 |

OTHER PUBLICATIONS

Japanese Office Action with English Translation (Application No. 2012-135837) (6 pages—dated Dec. 18, 2015).

European Search Report (Application No. 12828278.7—PCT/JP2012/068701) (12 pages—dated Nov. 18, 2015).

* cited by examiner

APPARATUS ID : A1234
PROCESS DATE AND TIME : YYYYMMDD/HH : MM
OPERATOR ID : 123456

COUNT CONTENTS

| | | |
|---|---|---|
| TEN-THOUSAND-YEN BILL | 20,000 | YEN(TWO) |
| FIVE-THOUSAND-YEN BILL | 5,000 | YEN(ONE) |
| TWO-THOUSAND-YEN BILL | 2,000 | YEN(ONE) |
| ONE-THOUSAND-YEN BILL | 1,000 | YEN(ONE) |
| SUBTOTAL | 28,000 | YEN |

MANUAL INPUT CONTENTS (SERIAL NUMBER: 001)

| | | |
|---|---|---|
| UNFIT NOTE/UNFIT COIN | 1,000 | YEN |
| GIFT TICKET | 12,000 | YEN |
| CHECK | 1,000 | YEN |
| OTHERS | 0 | YEN |
| SUBTOTAL | 14,000 | YEN |

TOTAL 42,000 YEN

FIG. 8

MONEY HANDLING MACHINE, MONEY HANDLING SYSTEM, MONEY HANDLING METHOD AND VALUABLE-MEDIUM HANDLING MACHINE

TECHNICAL FIELD

The present invention relates to a money handling machine configured to handle money such as banknotes, coins and so on, a money handling system including the money handling machine, and a money handling method for handling money by means of the money handling machine. In addition, the present invention relates to a valuable-medium handling machine configured to handle valuable media such as gift tickets, checks and so on.

BACKGROUND ART

In a store such as a supermarket, a convenience store and so on, there has been conventionally installed a deposit machine that performs a deposit process by depositing sales proceeds of the store and recognizing/counting the sales proceeds (see, for example, JP3542051B and JP3711068B). The conventional deposit machine is configured to store only money that could be recognized by a recognition unit of the deposit machine, and is configured to transmit money-deposit-data to an external apparatus. On the other hand, an unfit note/an unfit coin that cannot be recognized by the recognition unit of the deposit machine, and a valuable medium other than cash, such as a gift ticket, a check and so on, are not put into the deposit machine but separately managed by issuing a handwritten voucher.

SUMMARY OF THE INVENTION

In addition, as disclosed in JP3542051B or the like, in the conventional cash management system, when an armoured car company takes charge of security of a store by contract, a staff of the armoured car company regularly collects money and valuable medium stored in the deposit machine. When the money and the valuable media stored in the deposit machine have been collected by the staff of the armoured car company, a cash center under the management authority of the armoured car company transfers cash, which corresponds to a total amount of the collected money and the collected valuable media, to a bank account under the management authority of the store. Namely, the cash corresponding to the total amount of the money and the valuable media having been collected from the deposit machine by the staff of the armoured car company is transferred to the bank account under the management authority of the store.

In such a cash management system, a money recognition result by the recognition unit of the deposit machine is transmitted from the deposit machine to the cash center under the management authority of the armoured car company. On the other hand, an unfit note/an unfit coin that cannot be recognized by the recognition unit of the deposit machine, and a valuable medium other than cash, such as a gift ticket, a check and so on, are managed based on a handwritten voucher, separately from the deposit machine. Such a valuable medium is handed to the staff of the armoured car company who collects money in the deposit machine, and is then brought to the cash center. However, since the valuable medium is separately managed outside the deposit machine, another labor is needed therefor.

In the aforementioned cash management system, the contents described in the voucher brought back to the cash center and the actual valuable medium are compared to each other. When the fact that the contents described in the voucher and the actual valuable medium conform to each other has been confirmed, cash is transferred to the bank account under the management authority of the store. Thus, since the cash transfer operation to the bank account under the management authority of the store cannot be promptly performed, there is a problem for the store because it takes long time for cash corresponding to the total amount of the money and the valuable medium, which have been collected from the deposit machine, to be transferred to the bank account under the management authority of the store. In addition, when money cannot be deposited into the deposit machine, a manager of the store sometimes deposits another money in hand, which is not desirable in terms of cash management.

The present invention has been made in view of the above circumstances. The object of the present invention is to provide a money handling machine, a money handling system and a money handling method, which are capable of promptly transferring cash to a bank account under the management authority of a store, and are capable of comparing information related to a valuable medium, which has been transmitted from the money handling machine to an external apparatus, and the valuable medium, which has been actually collected from the money handling machine and brought to the external apparatus, with each other.

In addition, another object of the present invention is to provide a valuable-medium handling machine which is capable of promptly transferring cash to a bank account under the management authority of a store, and is capable of comparing information related to a second valuable medium, which has been transmitted from the valuable-medium handling machine to an external apparatus, and the second valuable medium, which has been actually collected from the valuable-medium handling machine and brought to the external apparatus, with each other.

The money handling machine of the present invention is a money handling machine including: a recognition unit configured to recognize money; a storing unit configured to store money having been recognized by the recognition unit, and a valuable medium having not been recognized by the recognition unit; an input unit for inputting information related to the valuable medium to be stored into the storing unit; and a control unit configured to transmit a money recognition result by the recognition unit and information related to the valuable medium having been inputted through the input unit, distinguishably from each other, to an external apparatus.

According to such a money handling machine, since the money recognition result by the recognition unit and the information related to the valuable medium, which has been inputted through the input unit, are transmitted to the external apparatus, a cash transfer operation to a bank account under the management authority of the store can be promptly performed by the external apparatus. In addition, in the external apparatus, the information related to the valuable medium, which has been transmitted from the money handling machine, and the valuable medium, which has been actually collected from the money handling machine and brought to the external apparatus, can be compared to each other.

Another money handling machine of the present invention is a money handling machine including: a recognition unit configured to recognize money; a storing unit configured to store money having been recognized by the recognition unit, and a valuable medium having not been recognized by the recognition unit; an input unit for inputting information related to the valuable medium to be stored into the storing unit by a manager having a first management authority; and a control unit configured to transmit a money recognition result by the recognition unit and information related to the valuable medium having been inputted through the input unit, to an external apparatus that is under a second management authority different from the first management authority.

According to such a money handling machine, since the money recognition result by the recognition unit and the information related to the valuable medium, which has been inputted through the input unit, are transmitted to the external apparatus that is under the second management authority different from the first management authority, a cash transfer operation to a bank account under the management authority of the store can be promptly performed by the external apparatus. In addition, in the external apparatus, the information related to the valuable medium, which has been transmitted from the money handling machine, and the valuable medium, which has been actually collected from the money handling machine and brought to the external apparatus, can be compared to each other.

In the money handling machine of the present invention, the money and the valuable medium stored in the storing unit may be under the second management authority.

In the money handling machine of the present invention, the control unit may be configured to transmit the money recognition result by the recognition unit and the information related to the valuable medium having been inputted through the input unit, distinguishably from each other, to the external apparatus.

In addition, the control unit may be configured to transmit the money recognition result by the recognition unit and information related to a total amount of the money and the valuable medium stored in the storing unit, distinguishably from each other, to the external apparatus.

In addition, the control unit may be configured to transmit the information related to the valuable medium having been inputted through the input unit, and information related to a total amount of the money and the valuable medium stored in the storing unit, distinguishably from each other, to the external apparatus.

In the money handling machine of the present invention, the money having been recognized by the recognition unit and the valuable medium having not been recognized by the recognition unit may be stored in the storing unit in a mixed state.

Alternatively, the storing unit may be composed of a plurality of storing portions, and the money having been recognized by the recognition unit and the valuable medium having not been recognized by the recognition unit may be stored in different storing portions.

In the money handling machine of the present invention, a medium other than the valuable medium that is not equivalated to an amount of money may be capable of being stored into the storing unit; in storing a medium other than the money having been recognized by the recognition unit into the storing unit, whether or not the medium is a medium equivalated to an amount of money is elected, and only when the medium to be stored into the storing unit is a medium equivalated to an amount of money, information related to an amount of the medium may be inputted through the input unit.

The money handling system of the present invention is a money handling system including a money handling machine configured to handle money, and an external apparatus located distinguishably from the money handling machine and communicably connected to the money handling machine, wherein: the money handling machine including: a recognition unit configured to recognize money; a storing unit configured to store money having been recognized by the recognition unit, and a valuable medium having not been recognized by the recognition unit; an input unit for inputting information related to the valuable medium to be stored into the storing unit; and a control unit configured to transmit a money recognition result by the recognition unit and information related to the valuable medium having been inputted through the input unit, distinguishably from each other, to an external apparatus; and the external apparatus is configured to process the money recognition result by the recognition unit and the information related to the valuable medium having been inputted through the input unit, distinguishably from each other, based on the information obtained from the money handling machine.

Another money handling system of the present invention is a money handling system including a money handling machine configured to handle money, and an external apparatus located distinguishably from the money handling machine and communicably connected to the money handling machine, wherein: the money handling machine including: a recognition unit configured to recognize money; a storing unit configured to store money having been recognized by the recognition unit, and a valuable medium having not been recognized by the recognition unit; an input unit for inputting information related to the valuable medium to be stored into the storing unit by a manager having a first management authority; and a control unit configured to transmit a money recognition result by the recognition unit and information related to the valuable medium having been inputted through the input unit, to an external apparatus that is under a second management authority different from the first management authority; and the external apparatus is under a second management authority different from the first management authority.

The money handling method of the present invention is a money handling method including: recognizing money by a recognition unit; storing, into a storing unit, the money having been recognized by the recognition unit and a valuable medium having not been recognized by the recognition unit; inputting, through an input unit, information related to the valuable medium to be stored in the storing unit; and transmitting the money recognition result by the recognition unit, and the information related to the valuable medium having been inputted through the input unit, distinguishably from each other, to an external apparatus.

Another money handling method of the present invention is a money handling method including: recognizing money by a recognition unit; storing, into a storing unit, the money having been recognized by the recognition unit and a valuable medium having not been recognized by the recognition unit; inputting, through an input unit, information related to the valuable medium to be stored in the storing unit by a manager having a first management authority; and transmitting the money recognition result by the recognition unit, and the information related to the valuable medium having been inputted through the input unit, to an external apparatus that is under a second management authority different from the first management authority.

The valuable-medium handling machine of the present invention is a valuable-medium handling machine including: a recognition unit configured to recognize a valuable medium; a storing unit configured to store a first valuable medium having been recognized by the recognition unit and a second valuable medium having not been recognized by the recognition unit; an input unit for inputting information related to the second valuable medium not recognized by the recognition unit but stored in the storing unit, by a manager having a first management authority; and a control unit configured to transmit a recognition result of the first valuable medium by the recognition unit and information related to the second valuable medium having been inputted through the input unit, to an external apparatus that is under a second management authority different from the first management authority.

According to such a valuable-medium handling machine, since the recognition result of the first valuable medium by the recognition unit, and the information related to the second valuable medium, which has been inputted through the input unit, are transmitted to the external apparatus that is under the second management authority different from the first management authority, a cash transfer operation to a bank account under the management authority of the store can be promptly performed by the external apparatus. In addition, in the external apparatus, the information related to the second valuable medium, which has been transmitted from the valuable-medium handling machine, and the second valuable medium, which has been actually collected from the valuable-medium handling machine and brought to the external apparatus, can be compared to each other.

BRIEF DESCRIPTION OF THE DRAWINGS

FIG. 4 is a structural view showing a concrete structure of a display and input unit of the banknote deposit machine shown in FIG. 2 and so on;

FIG. 5 is a functional block view of the banknote deposit machine shown in FIG. 2 and so on;

FIG. 6A is a flowchart showing a general flow of a deposit process in the banknote deposit machine shown in FIG. 2 and so on;

FIG. 7A is a flowchart showing an operation in which a valuable medium is stored into the storing cassette of the banknote deposit machine shown in FIG. 2 and so on;

FIG. 7B is a flowchart showing an operation in which a valuable medium equivalated to an amount of money and/or a medium not equivalated to an amount of money are selectively stored into the storing cassette of the banknote deposit machine shown in FIG. 2 and so on;

FIG. 7C is a view showing a display screen of a monitor of the display and input unit, when a valuable medium equivalated to an amount of money and/or a medium not equivalated to an amount of money are selectively stored into the storing cassette of the banknote deposit machine shown in FIG. 2 and so on; and FIG. 8 is a view showing contents of information transmitted from a control unit of the banknote deposit machine to a store sever and to a cash center.

MODE FOR CARRYING OUT THE INVENTION

One embodiment of the present invention will be explained herebelow with reference to the drawings. FIGS. 1 to 8 are views showing a banknote deposit machine (money handling machine) in this embodiment, and a money handling system including the banknote deposit machine.

Figure 1:
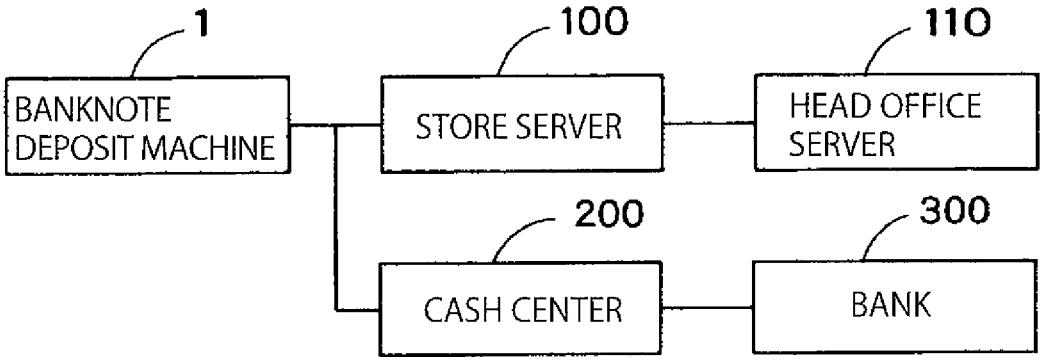
FIG. 1 is a view showing a structure of a money handling system including a banknote deposit machine in one embodiment of the present invention.

Firstly, the money handling system provided with the banknote deposit machine according to this embodiment is explained with reference to FIG. 1. As shown in FIG. 1, the money handling system includes the banknote deposit machine 1 configured to perform a banknote deposit process, a store server 100 located separately from the banknote deposit machine 1 and communicably connected with the banknote deposit machine 1, a head office server 110 communicably connected to the store server 100, and a cash center 200 located separately from the banknote deposit machine 1 and communicably connected to the banknote deposit machine 1. The banknote deposit machine 1 is installed in a store such as a supermarket, a convenience store and so on. The banknote deposit machine 1 is configured to perform a deposit process in which sales proceeds of the store are deposited thereinto and the sales proceeds are recognized/counted. In the banknote deposit machine 1, when an unfit note/an unfit coin that cannot be recognized by the banknote deposit machine 1 and/or a valuable medium other than cash, such as a gift ticket, a check and so on are stored into a storing cassette 70 (explained below), such valuable medium is manually counted by a clerk (operator) and an amount thereof is manually inputted to the banknote deposit machine 1.

The store server 100 is installed in a store where the banknote deposit machine 1 is installed. The store server 100 corresponds to a higher-level apparatus of the banknote deposit machine 1. On the other hand, the head office server 110 is installed on a location (e.g., head office) different from the respective stores, and is configured to put together information from the respective stores.

In addition, in the money handling system in this embodiment, an armoured car company takes charge of security of the store by agreement. The cash center 200 is under the management authority of the armoured car company. The cash center 200 is installed on a location different from the store where the banknote deposit machine 1 is installed. A staff of the armoured car company regularly collects a banknote(s) and a valuable medium(media) stored in the banknote deposit machine 1. After the banknote and the valuable medium stored in the banknote deposit machine 1 have been collected by a staff of the armoured car company, the collected banknote and the collected valuable medium are delivered to the cash center 200 by the staff of the armoured car company. The cash center 200 under the management authority of the armoured car company transmits, to a bank 300, information related to cash corresponding to a total amount of the collected banknote and the collected valuable media, as cash transfer information, and transfers cash corresponding to the total amount to a bank account under the management authority of the store. In this manner, the cash corresponding to the total amount of the banknote and the valuable medium, which have been collected from the banknote deposit machine 1 by the staff of the armoured car company, is transferred to the bank account under the management authority of the store.

Herebelow, a detailed structure of the banknote deposit machine 1 is explained with reference to FIGS. 2 to 5.

Figure 2:
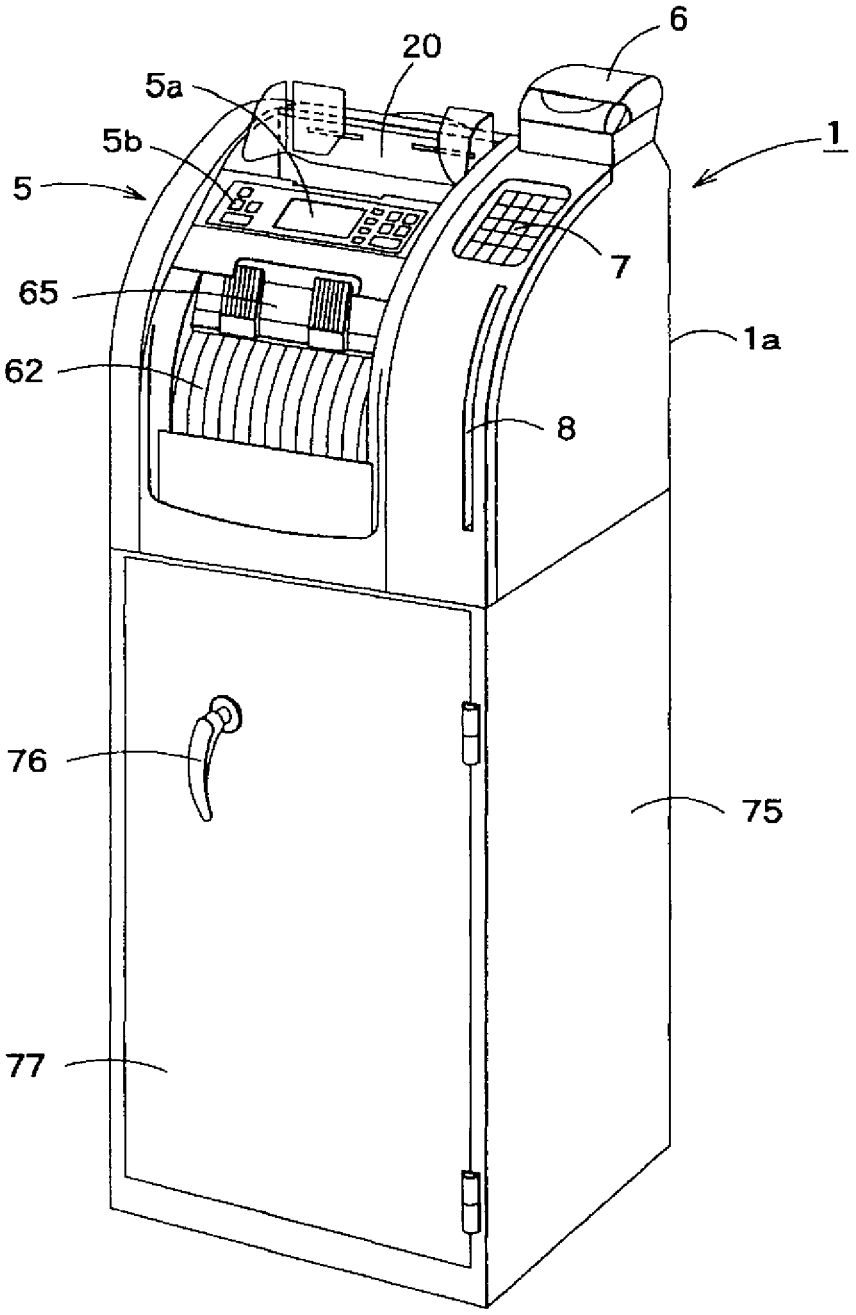
FIG. 2 is a perspective view showing a structure of the banknote deposit machine in the money handling system shown in FIG. 1.
Figure 3:
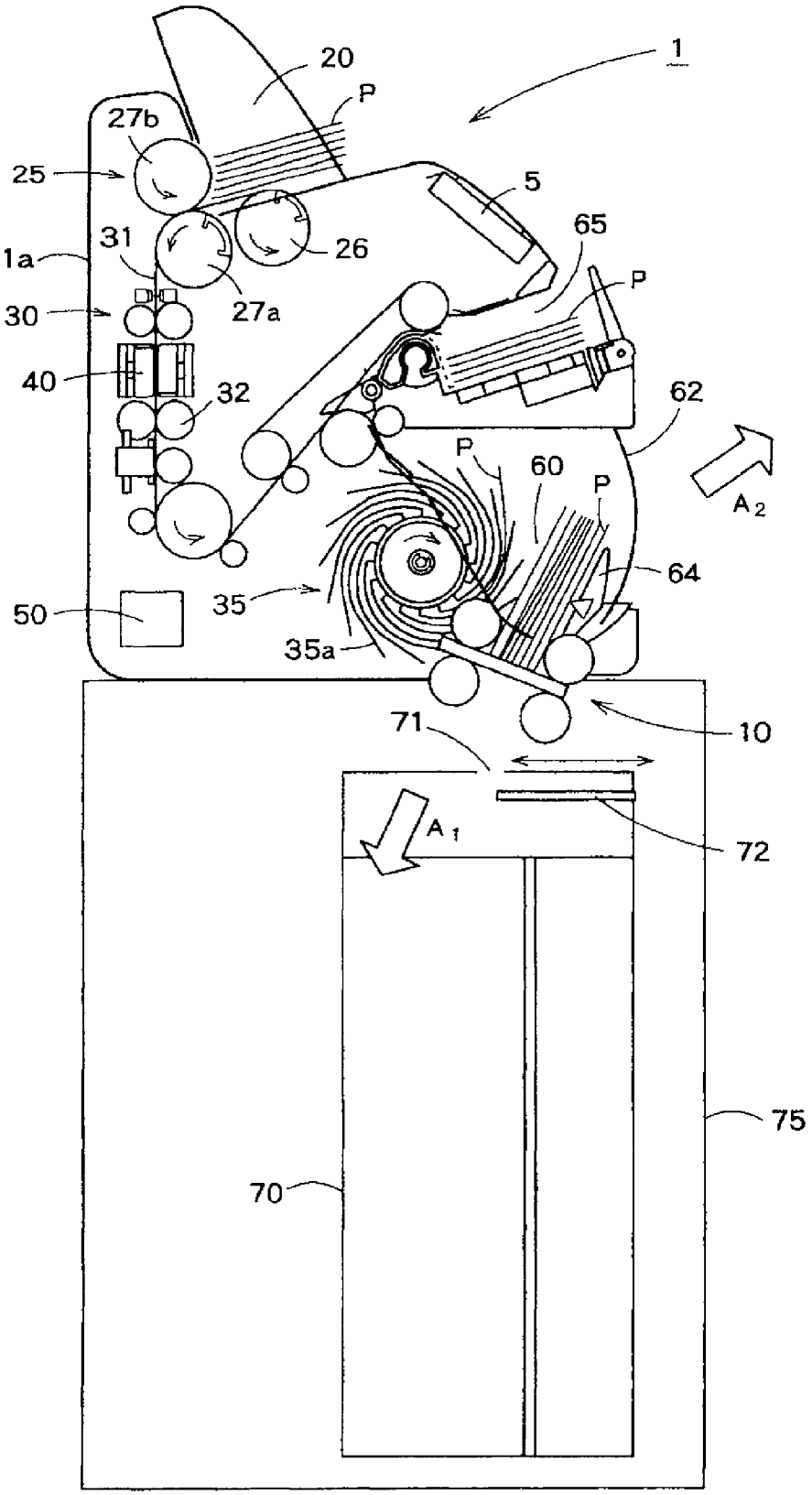
FIG. 3 is a side sectional view of the banknote deposit machine shown in FIG. 2.

FIG. 2 is a perspective view showing a structure of the banknote deposit machine 1 in the money handling system shown in FIG. 1. FIG. 3 is a side sectional view of the banknote deposit machine 1 shown in FIG. 2. As shown in FIGS. 2 and 3, the banknote deposit machine 1 includes: a housing 1*a*, a placement unit 20 disposed on the housing 1*a*, on which a plurality of banknotes P are placed; a reception unit 25 configured to take the plurality of banknotes P placed on the placement unit 20, one by one, into the housing 1*a*; a transport unit 30 configured to transport the banknotes P having been taken in by the reception unit 25; a stacking unit 60 configured to stack the banknotes P having been transported by the transport unit 30; a recognition unit 40 disposed on the transport unit 30, the recognition unit 40 configured to recognize a denomination and authenticity of the banknotes P transported by the transport unit 30 and to count the banknotes P; and a storing cassette 70 configured to receive the banknotes P having been staked in the stacking unit 60 so as to be stored therein.

As shown in FIG. 3, the reception unit 25 includes: a kicker roller 26 configured to give a driving force to a banknote P located undermost of the plurality of banknotes P placed on the placement unit 20; and a feed roller 27*a* located on a downstream side of the kicker roller 26 in a feeding direction of the banknote P, the feed roller 27*a* configured to feed the banknote P having been kicked out by the kicker roller 26 into an inside of the housing 1*a*. A gate roller (reverse roller) 27*b* is disposed oppositely to the feed roller 27*a*. A gate unit is formed between the feed roller 27*a* and the gate roller 27*b*.

In addition, as shown in FIG. 3, the transport unit 30 is composed of a transport belt 31 configured to transport the banknotes P, a transport roller 32 and so on. At a most downstream position of the transport unit 30 and near to the stacking unit 60, there is disposed a stacking wheel 35 configured to receive the banknotes P having been transported by the transport unit 30, one by one, between vanes 35*a* so as to align and stack the banknotes P in the stacking unit 60.

In addition, as shown in FIG. 3, the stacking unit 60 has such a shape that the stacked banknotes P are inclined toward a front surface side. In the stacking unit 60, the banknotes P having been sent from the transport unit 30 are supported by a support unit 64, such that the banknotes P are stacked so as to be inclined toward the front surface side in a standing condition. In this patent application, the front surface side means a side on which an operator places a banknote P on the placement unit 20 and takes a banknote P from the stacking unit 60. In FIG. 3, the front surface side is the right side. On the other hand, in this patent application, a rear surface side means a side opposed to the front surface side, which is the left side in FIG. 3.

In addition, as shown in FIGS. 2 and 3, disposed on the front surface side of the stacking unit 60 is a front shutter unit 62 for opening and closing a front opening from which stacked banknotes P are taken out from outside. The front shutter unit 62 is controlled by a below-described control unit 50, such that the front shutter unit 62 cannot be opened at least while a banknote P is transported to the storing cassette 70 by a clamping transport mechanism 10 (explained below).

In addition, as shown in FIG. 3, the stacking unit 60 is provided with a clamping transport mechanism 10 configured to clamp surfaces of banknotes P stacked in the stacking unit 60 and to transport the banknotes P in a direction parallel with the surfaces, such that the banknotes P are stored into the storing cassette 70. To be more specific, the clamping transport mechanism 10 is configured to clamp a surface of a banknote P that is located forefront of the banknotes P stacked in the stacking unit 60 and a surface of a banknote P that is located rearmost thereof, and is configured to simultaneously transport the plurality of banknotes P to the storing cassette 70 (see arrow $A_1$ in FIG. 3).

In addition, as shown in FIG. 3, the storing cassette 70 is provided with a slit opening 71 for taking in the banknotes P having been transported by the clamping transport mechanism 10, and a slit shutter unit 72 for opening and closing the slit opening 71. The storing cassette 70 is stored in a storing housing 75 shown in FIG. 2 such that the storing cassette 70 can be drawn out therefrom. In addition, as shown in FIG. 2, by opening a door 77, the storing cassette 70 can be loaded into the banknote deposit machine 1 and removed therefrom. In more detail, the door 77 is provided with a handle 76 and an electromagnetic key (not shown). By controlling to unlock the electromagnetic key, the handle 76 can be rotated to open the door 77. The removal of the storing cassette 70 is carried out by a staff of an armoured car company. An operation for controlling to unlock the electromagnetic key and rotating the handle 76 to open the door 77 may be set to be performed not only by a staff of an armored car company but also by a clerk of the store. The storing cassette 70 having been removed from the storing housing 75 by a staff of the armoured car company is brought to the cash center 200.

A banknote flow when a banknote(s) is put into the banknote deposit machine 1 and a flow of a valuable medium (media) put thereinto from outside are briefly explained. When a plurality of banknotes are placed on the placement unit 20 in order to put the banknotes into the banknote deposit machine 1, the banknotes are taken, one by one, into an apparatus body by the reception unit 25. The banknotes are recognized by the recognition unit 40 and are then sent to the stacking unit 60 or a reject unit 65. Thereafter, the banknotes stacked in the stacking unit 60 are stored into the storing cassette 70. When a valuable medium(media) is put into the banknote deposit machine 1, the front shutter unit 62 of the stacking unit 60 is opened. Then, an envelop containing the valuable medium is set in the stacking unit 60, and the envelope containing the valuable medium is stored into the storing cassette 70.

In this manner, in the banknote deposit machine 1 in this embodiment, a banknote P and a valuable medium are stored in a mixed state in the storing cassette 70. The banknote P and the valuable medium stored in the storing cassette 70 are not under the management authority of the store, but are under the management authority of the armoured car company.

Figure 4:
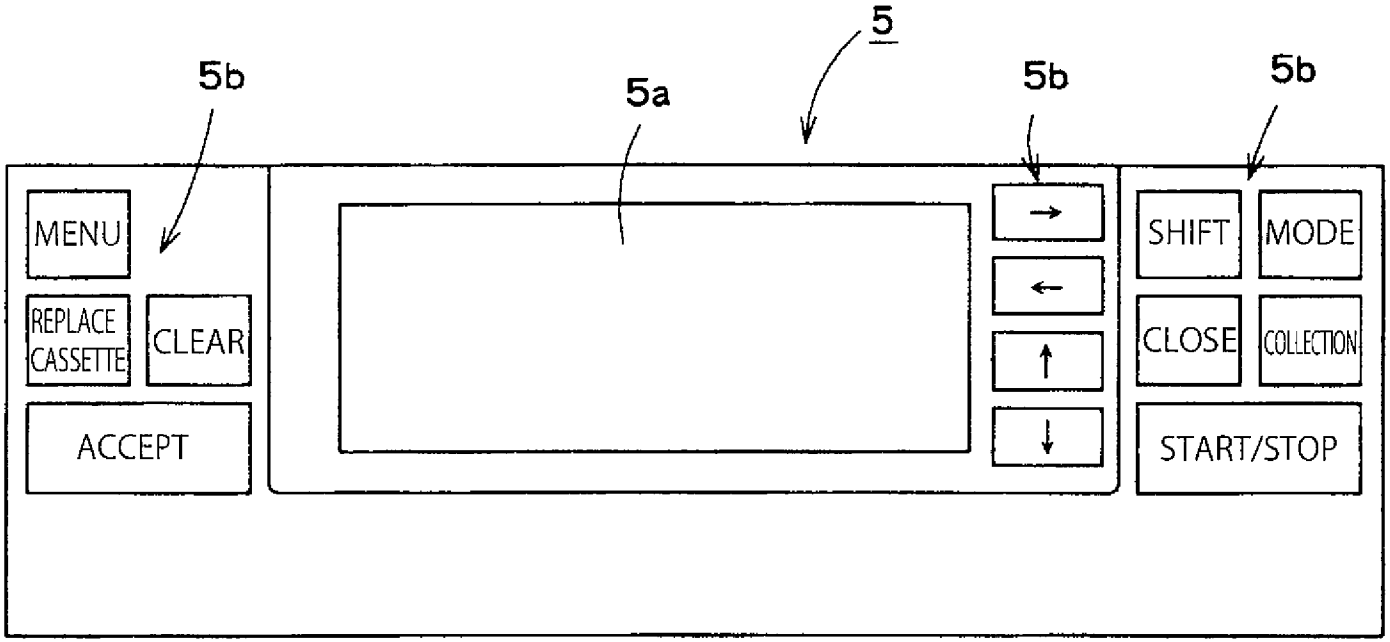

In addition, as shown in FIG. 2, the housing 1*a* of the banknote deposit machine 1 is provided with a display and input unit 5 having a function of displaying predetermined information and a function for enabling data input. A concrete structure of the display and input unit 5 is shown in FIG. 4. As shown in FIG. 4, the display and input unit 5 is composed of a monitor 5*a* which displays a count result of a banknote(s) P and so on, and a plurality of input keys 5*b* through which an operator inputs various instructions. The monitor 5*a* is configured to display, for example, the number of banknotes P stored in the storing cassette 70 for each denomination. As shown in FIG. 4, the plurality of input keys 5*b* are composed of a menu key, an exchange key, a clear key, a return key, an upward arrow key, a downward arrow key, a rightward arrow key, a leftward allow key, a shift key, a mode key, a close key, a collection key, a start/stop key and so on.

In addition, as shown in FIG. 2, the housing 1*a* of the banknote deposit machine 1 is provided with a printer 6 configured to print a count result of a banknote(s) P and so on, numeric keys 7 through which an operator inputs various numeric information to the below-described control unit 50, and a card reading unit 8 configured to read an ID card held by an operator for obtaining identification information of the operator.

In addition, as shown in FIG. 3, the transport unit 30 is provided with the reject unit 65 to which a banknote P is transported, when some error occurs so that the banknote P is not transported to the stacking unit 60.

The error herein means a recognition error and a transport error. The recognition error means that information recognized by the recognition unit 40 does not confirm to information stored in the control unit 50 in advance. For example, the recognition error includes an error in which a recognized banknote P is a banknote P whose kind is different from a preset kind, an error in which a kind of a banknote P could not be recognized, and so on.

The transport error means an error generated while a banknote(s) P is transported by the transport unit 30. For example, the transport error includes an error in which a banknote P is transported askew (skewed state), an error in which a plurality of banknotes P are transported without a predetermined interval therebetween (chain state), an error in which a plurality of banknotes P are transported in a overlapped manner (overlapped state) and so on.

Figure 5:
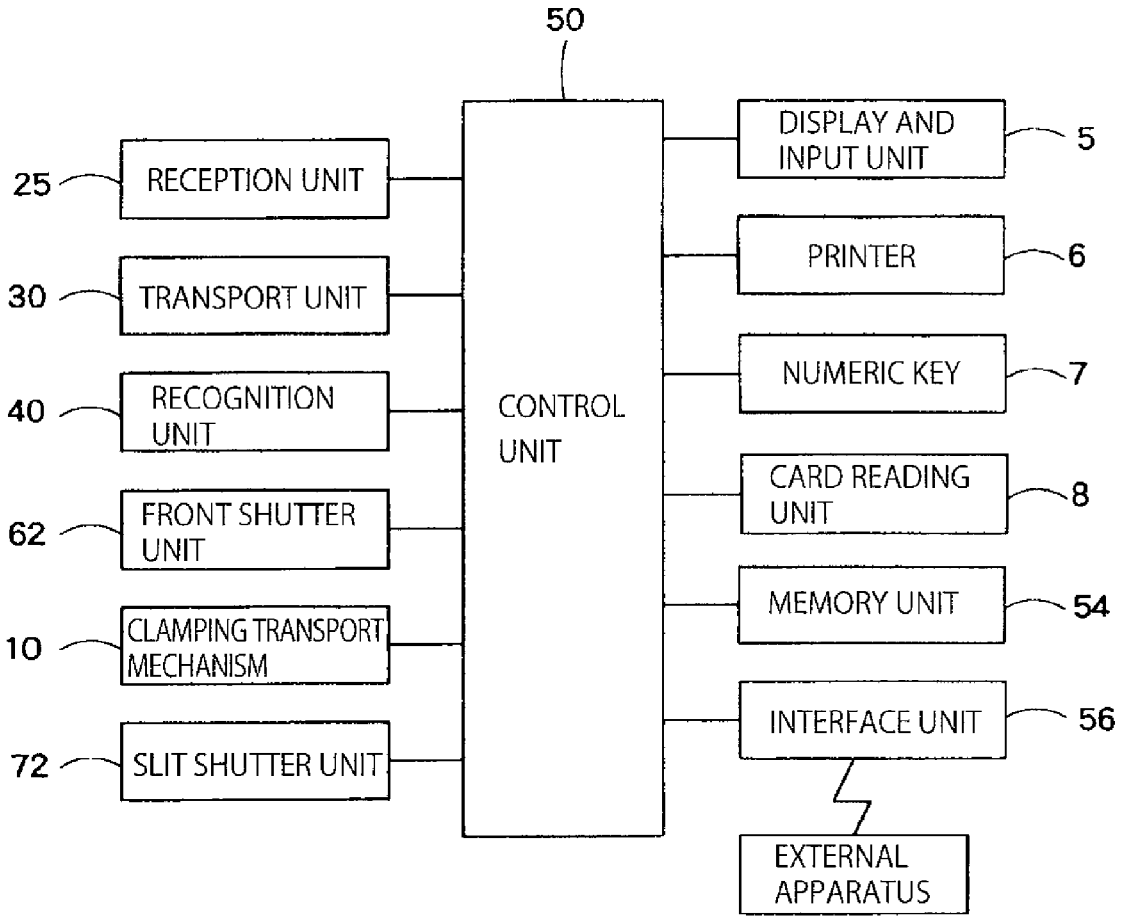

The banknote deposit machine 1 in this embodiment is provided with the control unit 50 as shown in FIG. 5. The control unit 50 is configured to control the respective constituent elements of the banknote deposit machine 1. As shown in FIG. 5, connected to the control unit 50 are the reception unit 25, the transport unit 30, the recognition unit 40, the front shutter unit 62, the clamping transport mechanism 10, the slit shutter unit 72, the display and input unit 5, the printer 6, the numeric keys 7, the card reading unit 8 and so on. Recognition/count information of a banknote(s) P having been recognized/counted by the recognition unit 40 is transmitted to the control unit 50. In addition, various instructions from an operator inputted through the respective input keys 5*b* of the display and input unit 5 and the numeric keys 7 are transmitted to the control unit 50. In addition, ID information of an operator having been read by the card reading unit 8 and so on are also transmitted to the control unit 50. In addition, the control unit 50 is configured to send control signals to the respective constituent elements, such as the reception unit 25, the transport unit 30, the front shutter unit 62, the clamping transport mechanism 10, the slit shutter unit 72, the display and input unit 5, the printer 6 and so on, so as to control these constituent elements.

In addition, as shown in FIG. 5, a memory unit 54 is connected to the control unit 50. The memory unit 54 is configured to store an apparatus ID for specifying the banknote deposit machine 1, preset information such as an ID of an operator who has a right to use the apparatus, a count result of a banknote(s) P and so on.

In addition, as shown in FIG. 5, an interface unit 56 is connected to the control unit 50. Through the interface unit 56, the control unit 50 can transmit a signal to an external apparatus, such as the store server 100, the cash center 200 and so on, and can receive a signal therefrom.

Next, an operation of the banknote deposit machine 1 as structured above is explained.

Figure 6A:
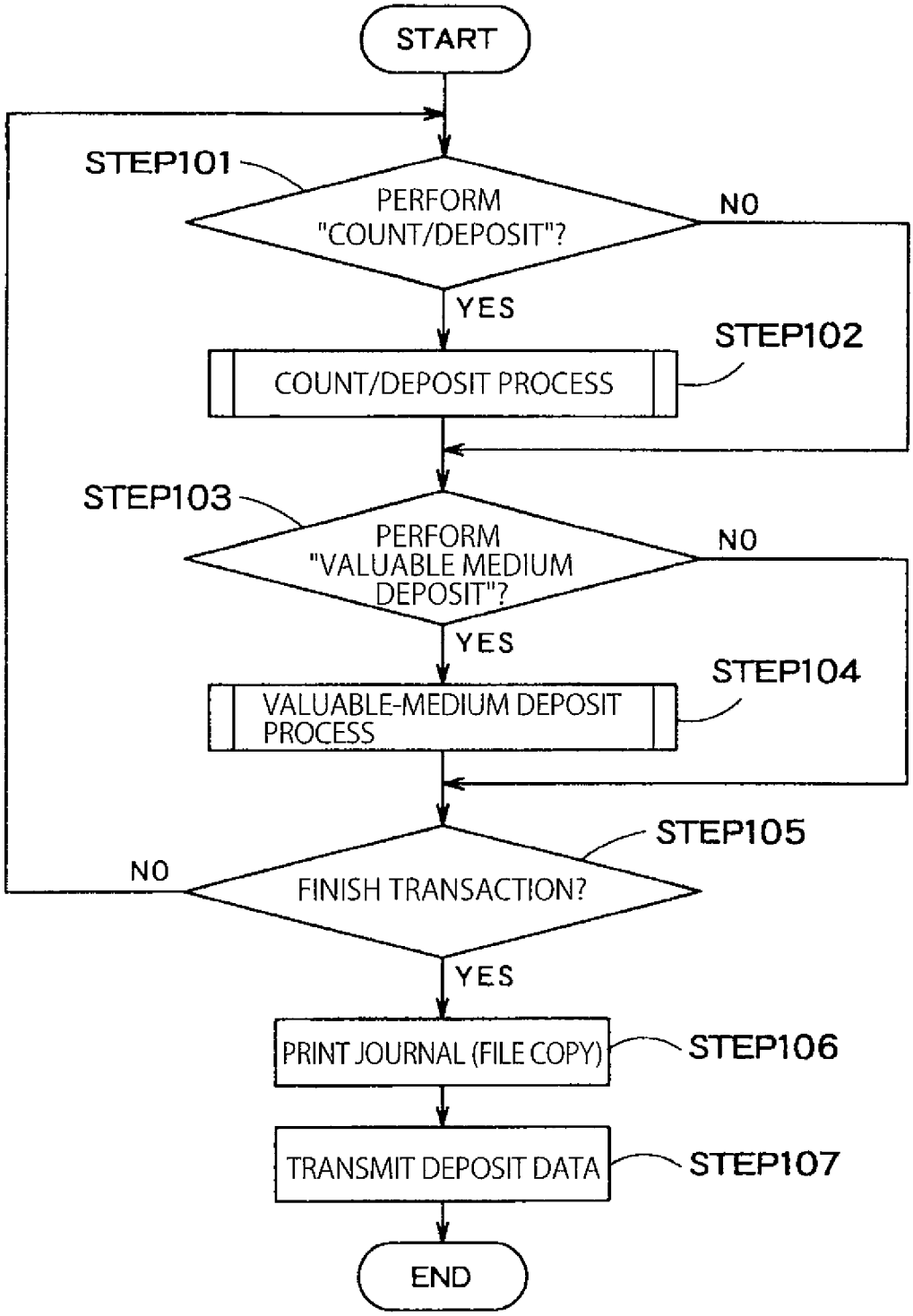

Firstly, a general flow of the deposit process in the banknote deposit machine 1 is described with reference to the flowchart shown in FIG. 6A. At the beginning, in the control unit 50, it is confirmed whether a count/deposit process is performed or not (STEP 101). To be specific, when an operator inputs an instruction for performing a deposit process of a banknote(s) P to the control unit 50 through the display and input unit 5, the below-described count/deposit process is performed (STEP 102). In addition, in the control unit 50, it is confirmed whether a valuable-medium deposit process is performed or not (STEP 103). To be specific, when an operator inputs an instruction for performing a deposit process of a valuable medium(media) other than a banknote P, to the control unit 50 through the display and input unit 5, the below-described valuable-medium deposit process is performed (STEP 104). Then, the count/deposit process and/or the valuable-medium deposit process are performed, so that the transaction is finished ("YES" in STEP 105). Then, a journal (file copy) is printed by the printer 6 (STEP 106). Thereafter, deposit data are transmitted from the control unit 50 to the store server 100 and/or the cash center 200 through the interface unit 56 (STEP 107).

Figure 6B:
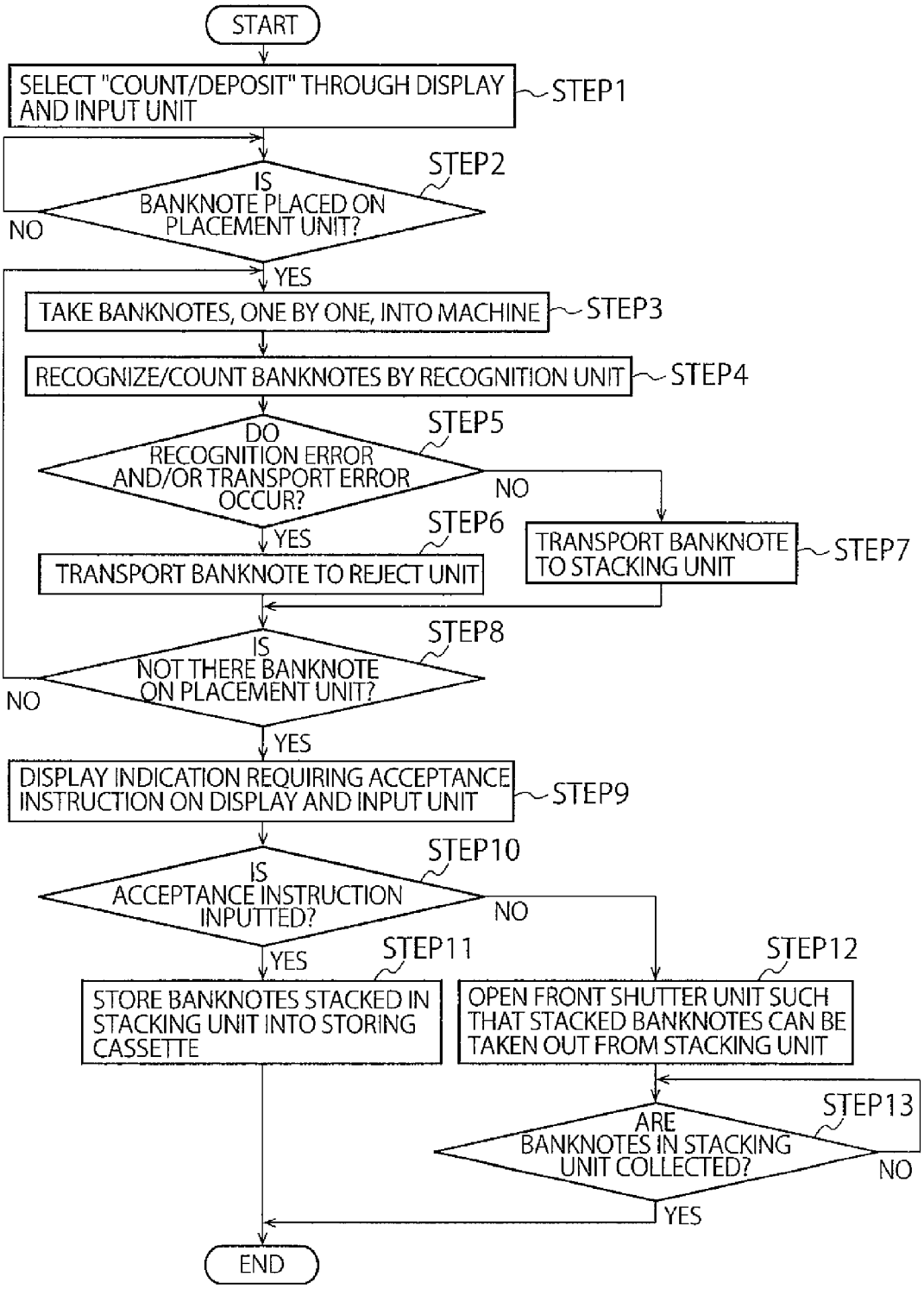
FIG. 6B is a flowchart showing an operation in which a banknote is deposited into the banknote deposit machine shown in FIG. 2 and so on, and the deposited banknote is recognized/counted and stored into a storing cassette.

Next, there is explained an operation for depositing a banknote(s) P to the banknote deposit machine 1, recognizing/counting the deposited banknote P, and storing the banknote P into the storing cassette 70, with reference to the flowchart shown in FIG. 6B. The operation shown below is performed based on signals transmitted from the control unit 50 to the respective units, unless otherwise noted.

At the beginning, an operator inputs an instruction for performing a deposit process of a banknote(s) P, to the control unit 50 through the display and input unit 5. To be more specific, the operator selects the command of "count and deposit" through the display and input unit 5 (STEP 1). At this time, ID information of the operator is inputted to the control unit 50 through the display and input unit 5 or the card reading unit 8. When such a signal is received by the control unit 50, the control unit 50 controls the front shutter unit 62 so as to be unopenable.

Then, when the operator places a plurality of banknotes P on the placement unit 20 ("YES" in STEP 2), the plurality of banknotes P placed on the placement unit 20 are taken, one by one, into the machine by the reception unit 25 (STEP 3). At this time, the undermost banknote P among the plurality of banknotes P placed on the placement unit 20 is kicked out by the kicker roller 26, and the banknote P is fed out by the feed roller 27*a*. The banknotes P are fed out, one by one, by the action of the gate roller 27*b*.

Following thereto, the banknotes P having been taken in by the reception unit 25 are transported by the transport unit 30. At this time, the banknotes P transported by the transport unit 30 are recognized/counted by the recognition unit 40 disposed on the transport unit 30 (STEP 4).

During the transport of the banknotes P by the transport unit 30, when the recognition error and/or the transport error occur ("YES" in STEP 5), the banknote(s) P is transported to the reject unit 65 (STEP 6). On the other hand, when the recognition error and/or the transport error do not occur ("NO" in STEP 5), the banknotes P being transported are transported to the stacking unit 60 (STEP 7).

When the banknotes P are transported to the stacking unit 60, the banknotes P are received between the vanes 35*a* of the stacking wheel 35 so as to be aligned and stacked in the stacking unit 60. Then, the banknotes P having been transported by the stacking wheel 35 are stacked in the stacking unit 60 such that the banknotes P are inclined toward the front surface side in a standing condition. The display and input unit 5 displays a total amount of the banknotes P stacked in the stacking unit 60. In addition, the recognition result (the number of banknotes for each denomination, the total amount and so on) together with the ID of the operator is stored in the memory unit 54.

In the above manner, when all the plurality of banknotes P placed on the placement unit 20 have been transported to the stacking unit 60 so that no banknote P remains on the placement unit 20 ("YES" in STEP 8), an indication for requiring an acceptance instruction for the total amount of the banknotes P stacked in the stacking unit 60 is displayed on the display and input unit 5 (STEP 9).

Then, as shown in "YES" in STEP 10, when the acceptance instruction is inputted by the operator through the display and input unit 5 (specifically, when the operator presses down the return key of the display and input unit 5), the plurality of banknotes P stacked in the stacking unit 60 are stored into the storing cassette 70 through the slit opening 71 by the clamping transport mechanism 10 (STEP 11) (see arrow $A_1$ of FIG. 3). At this time, the slit shutter unit 72 is moved on the front surface side so that the slit-like slit opening 71 is opened. On the other hand, except when a banknote(s) P is stored in the storing cassette 70, the slit shutter unit 72 is moved on the rear surface side so that the slit opening 71 is closed. After the banknotes P have been stored into the storing cassette 70, the banknotes P in the storing cassette 70 are not under the management authority of the store but under the management authority of the armored car company.

When there is a banknote(s) P in the reject unit 65, the operator places the banknote P again on the placement unit 20. Thus, the steps as described above are repeated so that all the banknotes P are transported to the stacking unit 60. However, a banknote P, which is transported to the reject unit 65 no matter how many times the operator tries, is judged as an unreceivable banknote P, and such a banknote P is excluded from the banknotes to be stored. In addition, when the operator does not accept the total amount ("NO" in STEP 10), by inputting a return instruction through the display and input unit 5, the front shutter unit 62 is opened, whereby the stacked banknotes P can be taken out (STEP 12) (see arrow $A_2$ of FIG. 3). When the banknotes P stacked in the stacking unit 60 have been collected by the operator ("YES" in STEP 13), the process is finished.

Figure 7A:
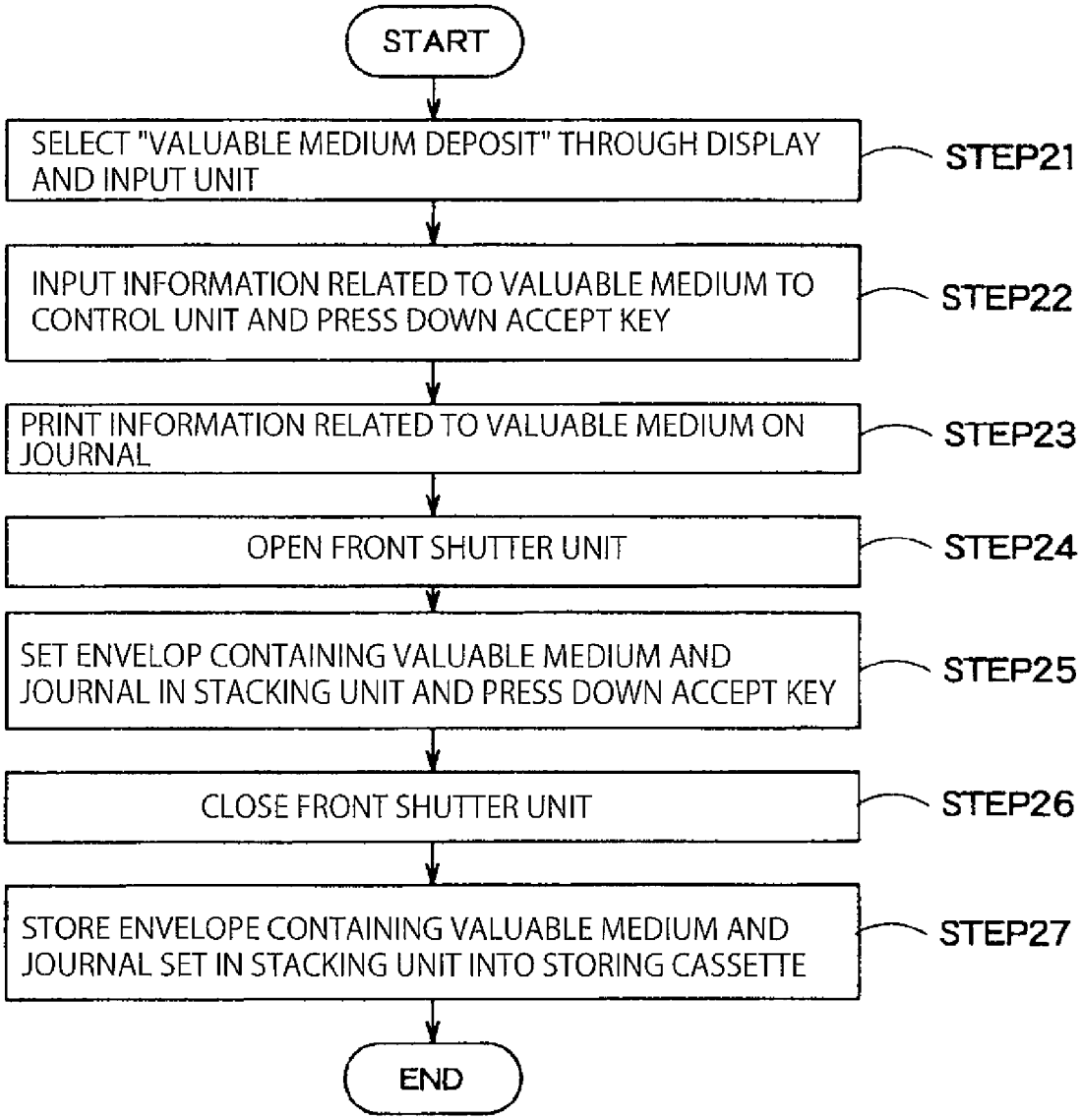

Next, there is explained an operation in which an unfit note/an unfit coin that cannot be recognized by the recognition unit 40 of the banknote deposit machine 1 and a valuable medium other than cash, such as a gift ticket, a check and so on, are stored into the storing cassette 70 of the banknote deposit machine 1, with reference to the flowchart shown in FIG. 7A. The operation shown below is performed based on signals transmitted from the control unit 50 to the respective units, unless otherwise noted.

At the beginning, an operator inputs an instruction for performing a deposit process of a valuable medium other than a banknote P, to the control unit 50 through the display and input unit 5. To be more specific, the operator selects the command of "valuable-medium deposit (other than cash)" through the display and input unit 5 (STEP 21). At this time, ID information of the operator is inputted to the control unit 50 through the display and input unit 5. The inputted data are stored as manually input data in the memory unit 54.

Then, the operator inputs information related to the valuable medium, specifically, an amount (of money) of the valuable medium and so on, to the control unit 50 through the display and input unit 5, and presses down the return key (STEP 22). Then, the information related to the valuable medium, which has been inputted by the operator to the control unit 50, is printed on a journal by the printer 6 (STEP 23). In addition, at this time, the front shutter unit 62 is opened by the control unit 50 (STEP 24), whereby an envelope containing the valuable medium can be put into the stacking unit 60.

After that, when the operator sets on the stacking unit 60 the envelope containing the valuable medium and the journal on which the information of the valuable medium is printed, and presses down the return key (STEP 25), the front shutter unit 62 is closed (STEP 26). Then, the envelope containing the valuable medium and the journal, which have been set in the stacking unit 60, are stored into the storing cassette 70 through the slit opening 71 by the clamping transport mechanism 10 (STEP 27) (see arrow $A_1$ of FIG. 3). After the envelope containing the valuable medium has been stored into the storing cassette 70, the valuable medium in the storing cassette 70 is not under the management authority of the store but under the management authority of the armoured car company. In this manner, the operation for storing the valuable medium into the storing cassette 70 is finished.

In this embodiment, in addition to a valuable medium equivalated (correlated) to an amount of money, a medium not equivalated to an amount of money may be also stored into the storing cassette 70 of the banknote deposit machine 1. To be specific, a sales slip of the store, a discount ticket or service ticket issued by the store, a journal on which sales proceeds other than those of the current day are printed, a letter exchanged between the store and the armoured car company and so on, for example, may be stored as a medium not equivalated to an amount of money into the storing cassette 70. In this case, these medium together with the storing cassette 70 are sent from the store to the armoured car company and sent from the armoured car company to the store. There is explained an operation in which, in a case where a medium not equivalated to an amount of money can be stored into the storing cassette 70 of the banknote deposit machine 1, a valuable medium equivalated to an amount of money and a medium not equivalated to an amount of money are selectively stored into the storing cassette 70 of the banknote deposit machine 1, with reference to the flowchart shown in FIG. 7B and the display screen of the monitor 5*a* of the display and input unit 5 shown in FIG. 7C.

At the beginning, an operator inputs an instruction for performing a deposit process of a medium other than a banknote P, to the control unit 50 through the display and input unit 5. To be more specific, the operator selects the command of "Put in Medium" through the display and input unit 5 (STEP 31). At this time, ID information of the operator is inputted to the control unit 50 through the display and input unit 5. The input data are stored as manually input data to the memory unit 54.

Figure 7B:
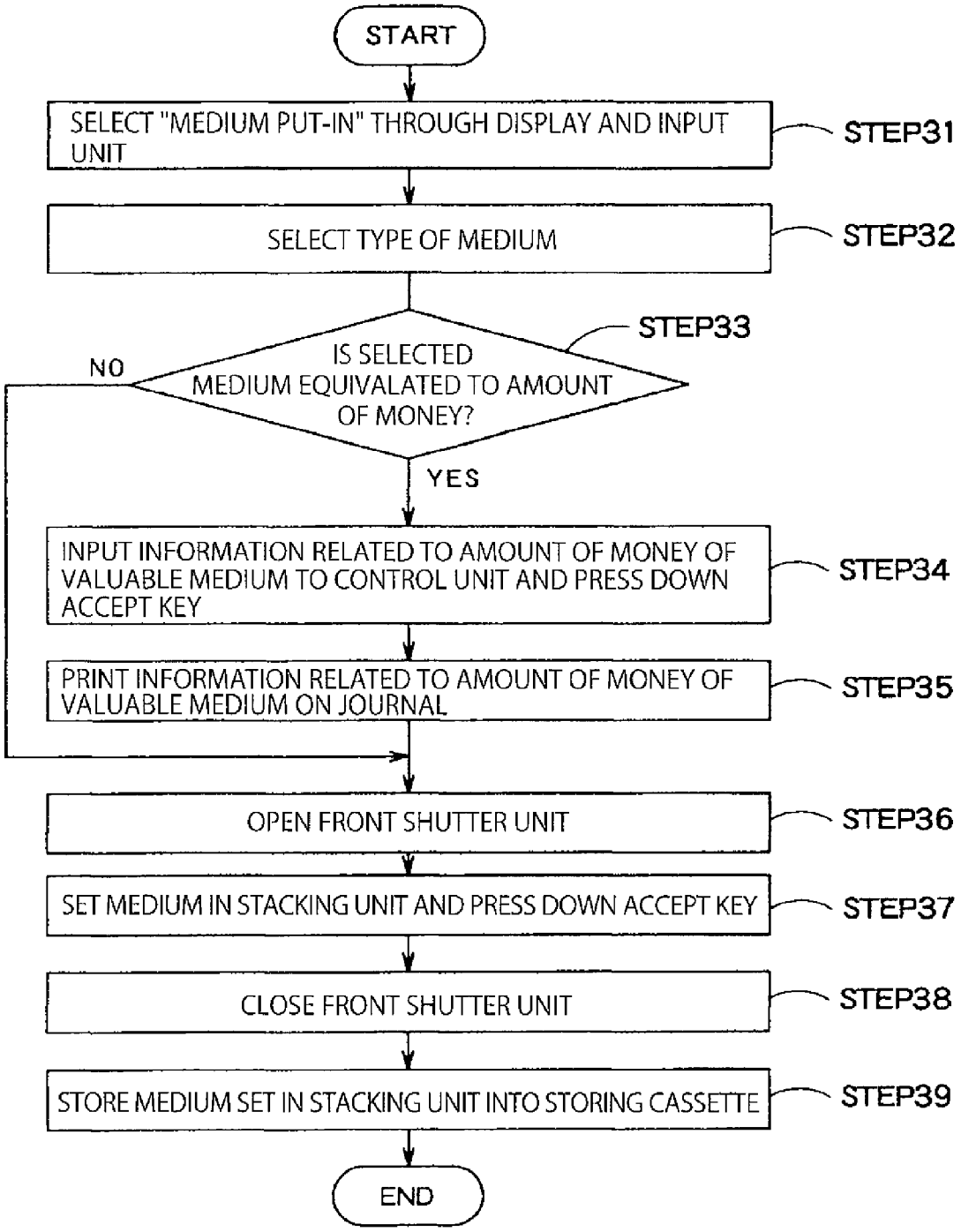
Figure 7C:
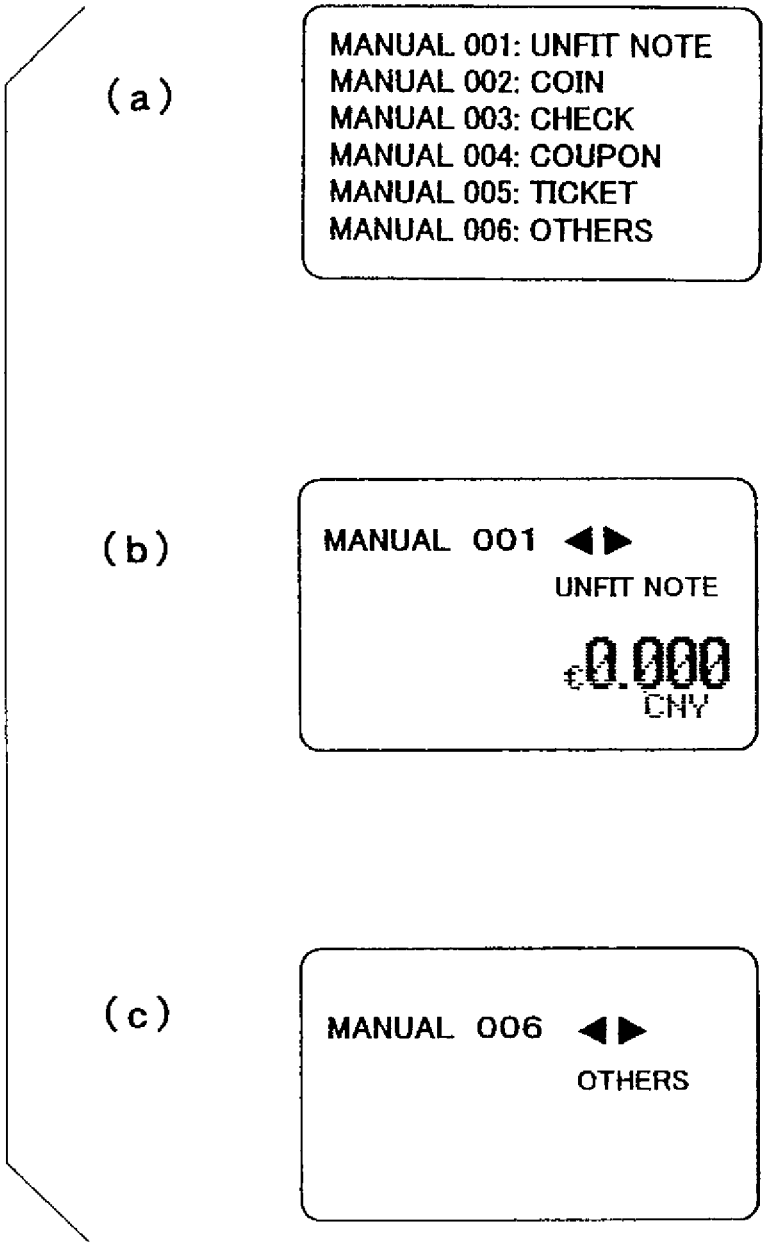

When the command "medium put-in" is selected through the display and input unit 5, the display screen shown in FIG. 7C(a) is displayed on the monitor 5*a* of the display and input unit 5. Specifically, as shown in FIG. 7C(a), a list of plural types of media is displayed. In FIG. 7C(a), "UNFIT NOTE" means an unfit note, "COIN" means a coin and "CHECK" means a check. In addition, "COUPON" means a coupon ticket, "TICKET" means a gift ticket and "OTHERS" means a medium other than them. In more detail, an unfit note, a coin, a check, a coupon ticket and a gift ticket are valuable media equivalated to an amount of money. Meanwhile, a medium other than them (corresponding to "OTHERS") is a medium not equivalated to an amount of money. The operator selects a type of the medium by pressing down the input key 5*b* (specifically, right and left numeric keys) of the display and input unit 5 from the list displayed on the display screen shown in FIG. 7C(a). As to the list of the plural types of media in the display screen shown in FIG. 7C(a), the titles of these items and their order can be changed by an operator through the display and input unit 5.

When the selected medium is a medium that is equivalated to an amount of money, specifically, an unfit note, a coin, a check, a coupon ticket or a gift ticket ("YES" in STEP 33), the operator inputs information related to an amount of money of the valuable medium, to the control unit 50 through the display and input unit 5, and presses down the return key (STEP 34). In more detail, when a medium equivalated to an amount of money, e.g., an unfit not, is selected in the display screen shown in FIG. 7C(a), a display screen shown in FIG. 7C(b) is displayed on the monitor 5*a* of the display and input unit 5, whereby the number of unfit note(s) can be inputted. Then, the number of unfit note(s) is inputted and the return key is pressed down, and the information related to the amount of money of the valuable medium, which has been inputted to the control unit 50 by the operator, is printed on a journal (STEP 35). Thereafter, the front shutter unit 62 is opened (STEP 36), whereby an envelop containing the valuable medium and the journal on which the information related to the amount of money of the valuable medium is printed, can be put into the stacking unit 60.

On the other hand, when the selected medium is a medium that is not equivalated to an amount of money (specifically, when "MANUAL 006: OTHERS" in FIG. 7C(a) is selected) ("NO" in STEP 33), a display screen shown in FIG. 7C(c) is displayed on the monitor 5*a* of the display and input unit 5. In this case, the number of medium(media) is not inputted to the control unit 50. While the display screen shown in FIG. 7C(c) is displayed on the monitor 5*a* of the display and input unit 5, when the operator presses down the return key, the front shutter unit 62 is opened (STEP 36) whereby the medium itself can be put into the stacking unit 60. At this time, a message "OTHER" may be printed on the journal or the number of medium(media) not equivalated to an amount of money may be printed thereon.

When the operator sets the envelope containing the valuable medium or the medium not equivalated to an amount of money in the stacking unit 60 and presses down the return key (STEP 37), the front shutter unit 62 is closed (STEP 38). Then, the medium set in the stacking unit 60 is stored into the storing cassette 70 through the slit opening 71 by the clamping transport mechanism 10 (STEP 39). In this manner, a medium other than a valuable medium can be stored into the storing cassette 70.

As described above, according to the operation along the flowchart shown in FIG. 7B, a medium not equivalated to an amount of money can be stored into the storing cassette 70, in addition to a valuable medium. When a medium, which is other than a banknote having been recognized by the recognition unit 40, is stored into the storing cassette 70, whether or not the medium is a medium equivalated to an amount of money is selected. Only when the medium to be stored into the storing cassette 70 is a medium that is equivalated to an amount of money, information related to an amount of money of the medium is inputted through the display and input unit 5. Thus, when a medium not equivalated to an amount of money, such as a sales slit of the store and a letter or a liaison note exchanged between the store and the armoured car company, is stored into the storing cassette 70, it is not necessary to input information related to an amount of money of the medium. That is to say, in an operation for storing a medium (media), which is other than a banknote having been recognized by the recognition unit 40, into the storing cassette 70, suppose that information related to an amount of money of each of all the media should be necessarily inputted. In this case, when a medium not equivalated to an amount of money is stored into the storing cassette 70, a dummy amount of money should be temporarily inputted. At this time, there is a possibility that a total amount of money and a valuable medium(media) in the storing cassette 70 managed by the control unit 50 does not conform to the actual condition of the money and the valuable medium(media) stored in the storing cassette 70. However, according to the operation along the flowchart shown in FIG. 7B, such a trouble can be prevented.

In the money handling system in this embodiment, the recognition result of a banknote(s) P by the recognition unit 40 of the banknote deposit machine 1 is transmitted from the banknote deposit machine 1 to the store server 100, and is also transmitted to the cash center 200 under the management authority of the armoured car company. In addition, the information related to a valuable medium, which has been manually inputted through the display and input unit 5, is transmitted to the store server 100, and is also transmitted to the cash center 200 under the management authority of the armoured car company.

To be specific, after the count/deposit process of a banknote(s) P as shown in the flowchart of FIG. 6B or the valuable-medium deposit process as shown in the flowchart of FIG. 7A has been finished, the recognition result of the banknote(s) P by the recognition unit 40 and the information related to the valuable medium(media), which has been manually inputted through the display and input unit 5, are transmitted from the control unit 50 of the banknote deposit machine 1 to the store server 100 and to the cash center 200 through the interface unit 56. In more detail, the ID information of the operator which has been inputted to the control unit 50 through the display and input unit 5, the count data of the banknote(s) P by the recognition unit 40, and the manually input data, such as an amount of money of the valuable medium(media) and so on which have been manually inputted to the control unit 50 through the display and input unit 5 or the card reading unit 8, are transmitted, together with an apparatus ID and a process date and time information, from the control unit 50 of the banknote deposit machine 1 to the store server 100 and to the cash center 200 through the interface unit 56. In addition, at this time, a serial number, which connects the actual valuable medium and the manually input data, such as an amount of money of the valuable medium and so on which has been manually inputted to the control unit 50 through the display and input unit 5, to each other, is transmitted from the control unit 50 of the banknote deposit machine 1 to the store server 100 and the cash center 200 through the interface unit 56.

FIG. 8 shows contents of the information transmitted from the control unit 50 of the banknote deposit machine 1 to the store server 100 and to the cash center 200 through the interface unit 56. As shown in FIG. 8, the apparatus ID information, the process date and time (in FIG. 8, the process date and time is expressed as YYYY(year) MM(month) DD(date)/HH (hour): MM(minutes)), the operator's ID information, the count data of a banknote(s) P by the recognition unit 40, the manually input data such as an amount of money of the valuable medium and so on which has been manually inputted to the control unit 50 through the display and input unit 5, the serial number, and the information related to a total amount of the banknote(s) P and the valuable medium(media) stored in the storing cassette 70, are transmitted from the control unit 50 of the banknote deposit machine 1 to the store server 100 and to the cash center 200 through the interface unit 56.

In addition, in this embodiment, the control unit 50 of the banknote deposit machine 1 is configured to transmit the count data of a banknote(s) P by the recognition unit 40 and the manually input data such as an amount of money of the valuable medium and so on which has been manually inputted to the control unit 50 through the display and input unit 5, distinguishably from each other, to the store server 100 and to the cash center 200. Namely, the count data of a banknote(s) P and the manually input data such as the amount of money of the valuable medium(media) and so on are transmitted not as integral information to the store server 100 and to the cash center 200, but the count data of a banknote(s) P and the manually input data such as the amount of money of the valuable medium(media) and so on are transmitted as separate information to the store server 100 and to the cash center 200.

In addition, the control unit 50 of the banknote deposit machine 1 may transmit the count data of a banknote(s) P and the information related to a total amount of the banknote(s) P and the valuable medium(media) stored in the storing cassette 70, distinguishably from each other, to the store server 100 and to the cash center 200. In addition, the control unit 50 of the banknote deposit machine 1 may transmit the manually input data such as an amount of money of a valuable medium (media) and so on, which have been manually inputted to the control unit 50 through the display and input unit 5, and the information related to a total amount of the banknote(s) P and the valuable medium(media) stored in the storing cassette 70, distinguishably from each other, to the store server 100 and to the cash center 200.

In this manner, when the information having the contents shown in FIG. 8 has been transmitted to the cash center 200 under the control and the authority of the armoured car company, the cash center 200 transmits, to the bank 300, the information related to the total amount of the banknote(s) P and the valuable medium(media) stored in the storing cassette 70, which has been transmitted from the control unit 50 of the banknote deposit machine 1, as cash transfer information, and transfers cash corresponding to the amount to a bank account under the management authority of the store. In this manner, the cash corresponding to the total amount of the banknote(s) P and the valuable medium(media) having been collected from the banknote deposit machine 1 by the staff of the armoured car company is rapidly transferred to the bank account under the management authority of the store.

In addition, in the cash center 200, the information related to the valuable medium(media), which has been transmitted from the control unit 50 of the banknote deposit machine 1, and the valuable medium(media), which has been actually collected from the banknote deposit machine 1 by the staff of the armoured car company and brought to the cash center 200, are compared to each other. When the former information and the latter information do not conform to each other, the cash center 200 transmits to the bank 300 information related to an excessive or deficit amount, and deposits or dispenses cash corresponding to the excess or the deficit to or from the bank account under the management authority of the store.

According to the banknote deposit machine 1 (money handling machine) in this embodiment and the money handling system including this banknote deposit machine 1, information related to a valuable medium(media) to be stored into the storing cassette 70 is inputted to the banknote deposit machine 1 through the display and input unit 5 by a manager having a first management authority (specifically a clerk of a store). The control unit 50 of the banknote deposit machine 1 is configured to transmit a recognition result of a banknote(s) P by the recognition unit 40 and the information related to the valuable medium(media), which has been inputted through the display and input unit 5, to the cash center 200 under a second management authority (specifically, under the management authority of the armored car company) that is different from the first management authority. Thus, a cash transfer operation to a bank account under the management authority of the store can be promptly performed by the cash center 200. In addition, in the cash center 200, the information related to the valuable medium(media), which has been transmitted from the banknote deposit machine 1, and the valuable medium(media), which has been actually collected from the banknote deposit machine 1 and brought to the cash center 200, can be compared to each other.

In addition, in the banknote deposit machine 1 in this embodiment, the banknote(s) P and the valuable medium (media) stored in the storing cassette 70 are under the second management authority (specifically, under the management authority of the armored car company).

In addition, as described above, in the banknote deposit machine 1 in this embodiment, the control unit 50 is configured to transmit the recognition result of the banknote(s) P by the recognition unit 40 and the information related to the valuable medium(media), which has been inputted through the display and input unit 5, distinguishably from each other, to the the cash center 200. Thus, when the cash center 200 transfers cash to the bank account under the management authority of the store, the following operation is possible. Namely, cash corresponding to the recognition result of the banknote(s) P by the recognition unit 40 is immediately transferred to the bank account under the management authority of the store. Meanwhile, as to the information related to the valuable medium(media), which has been inputted through the display and input unit 5, after the information and the valuable medium(media), which has been actually collected from the banknote deposit machine 1 and brought to the cash center 200, have been compared to each other, cash is transferred to the bank account under the management authority of the store. Further, the recognized banknote data and the manually inputted data can be reckoned distinguishably from each other.

In addition, in the banknote deposit machine 1 in this embodiment, the recognition result of the banknote(s) P by the recognition unit 40 and the information related to a total amount of the banknote(s) P and the valuable medium(media) stored in the storing cassette 70 may be transmitted distinguishably from each other to the cash center 200. In addition, the control unit 50 may be configured to transmit the information related to the valuable medium(media), which has been inputted trough the display and input unit 5, and the information related to a total amount of the banknote(s) P and the valuable medium(media) stored in the storing cassette 70, distinguishably from each other, to the cash center 200.

In addition, in the banknote deposit machine 1 in this embodiment, the banknote(s) P recognized by the recognition unit 40 and the valuable medium(media) not recognized by the recognition unit 40 are stored in the storing cassette 70 in a mixed state. However, in this embodiment, the storing cassette 70 is not limited thereto. As an alternative example, the storing cassette is composed of a plurality of storing portions, so that the banknote(s) P recognized by the recognition unit 40 and the valuable medium(media) not recognized by the recognition unit 40 may be stored into storing portions different from each other.

The banknote deposit machine 1 in this embodiment and the money handling system including the banknote deposit machine 1 are not limited to the aforementioned embodiment, but can be variously modified.

In the banknote deposit machine 1 in an alternative example, the control unit 50 is capable of selecting and performing any one of a normal deposit mode in which a banknote P having been recognized by the recognition unit 40 is stored into the storing cassette 70, and a forced deposit mode in which money such as a banknote, a coin and so on is forcibly stored into the storing cassette 70. In the forced deposit mode, a banknote(s) placed on the placement unit 20 of the banknote deposit machine 1 is/are fed into the machine, and the banknotes are merely counted without being recognized by the recognition unit 40 and are then stacked in the stacking unit 60. After that, the banknotes are sent into the storing cassette 70 based on an acceptance operation. Loose banknotes are collected in such a forced deposit mode. At this time, an operator manually inputs an amount to be deposited and so on through the display and input unit 5. The control unit 50 adds the number of counted banknotes to the manually inputted data, and transmits these data to an external apparatus, such as a higher-level apparatus, through the interface unit 56.

In the banknote deposit machine 1 in the alternative example, the control unit 50 is configured to transmit a recognition result of a banknote(s) P by the recognition unit 40 in the normal deposit mode, and information related to a banknote(s) to be forcibly deposited in the forced deposit mode, which has been inputted through the display and input unit 5, to the store server 100 and to the cash center 200. Thus, a cash transfer operation to the bank account under the management authority of the store can be promptly performed by the cash center 200. In addition, in the cash center 200, the information related to the banknote(s) to be forcibly deposited, which has been transmitted from the banknote deposit machine 1, and the banknote(s), which has been actually collected from the banknote deposit machine 1 and brought to the cash center 200, can be compared to each other.

In addition, the external apparatus such as the store server 100, the cash center 200 and so on, may be configured to process the recognition result of the banknote(s) by the recognition unit 40, and the information related to the valuable medium(media), which has been inputted through the display and input unit 5, distinguishably from each other, based on the information obtained from the banknote deposit machine 1.

In addition, in the banknote deposit machine in another alternative example, a banknote having been recognized by the recognition unit 40 so as to be deposited, and a valuable medium deposited by a manual input may be stored into storing units separated from each other.

In addition, the money handling machine in the present invention is not limited to the banknote deposit machine 1 shown in FIG. 2 and so on. A coin deposit machine may be used as the money handling machine in this invention, and a machine other than a deposit machine may be used. At this time, in addition to a banknote that could not be recognized by the recognition unit 40 and a valuable medium such as a check and so on, coins (loose coins, rolled coins) may be deposited by a manual input. In addition, the timing at which the deposit data are transmitted to the external apparatus, such as the store server 100, the cash center 200 and so on, is not limited to a timing when the transaction is finished. Another timing is possible. For example, the deposit data are accumulated and stored in the memory unit 54, and when the number of transactions reaches a predetermined number (e.g., thirty transactions), the deposit data are transmitted to the external apparatus. Alternatively, it is possible that the deposit data are accumulated and stored in the memory unit 54, and that the deposit data are transmitted to the external apparatus every predetermined hours. Alternatively, it is possible that the deposit data are accumulated and stored in the memory unit 54, and that the deposit data are transmitted to the external apparatus based on an instruction from an external apparatus such as a higher-level apparatus. In this manner, by transmitting the deposit data in a mass, communication load can be reduced. In addition, a timing at which the deposit data are transmitted to the store server 100 and a timing at which the deposit data are transmitted to the cash center 200 may be differed from each other.

In addition, to transmit the deposit data based on recognition by the recognition unit 40 and the deposit data based on the manual input distinguishably from each other to the external apparatus such as a higher-level apparatus does not necessarily mean that separated data structures are transmitted at different timings. Even when the timing and/or the data structure are the same, an operation is included in a concept of "distinguishably transmitting data to the external apparatus" as long as the data contents can be separated and reckoned by an apparatus receiving the data in the operation.

In addition, in the present invention, a valuable-medium handling machine configured to handle a valuable medium may be used instead of the money handling machine. Such a valuable-medium handling machine has a structure similar to that of the banknote deposit machine 1 shown in FIG. 2 and so on. However, differently from the banknote deposit machine 1 shown in FIG. 2 and so on, a valuable medium of a predetermined type (e.g., check or the like) can be recognized by the recognition unit 40, and a first valuable medium having been recognized by the recognition unit 40 and a second valuable medium not recognized by the recognition unit 40 are respectively stored into the storing cassette(s) 70. In addition, in such a valuable-medium handling machine, information related to the second valuable medium stored in the storing cassette 70 is inputted by a manager having a first management authority (e.g., a clerk of a store) through the display and input unit 5. Further, in the valuable-medium handling machine according to the present invention, the control unit 50 is configured to transmit a recognition result of the first valuable medium by the recognition unit 40, and the information related to the second valuable medium, which has been inputted through the display and input unit 5, to the cash center 200 under a second management authority (e.g., under the management authority of the armored car company) that is different from the first management authority.

According to such a valuable-medium handling machine, since the recognition result of the first valuable medium by the recognition unit 40 and the information related to the second valuable medium, which has been inputted through the display and input unit 5, are transmitted to the cash center 200 under the second management authority (e.g., under the management authority of the armored car company) that is different from the first management authority, a cash transfer operation to a bank account under the management authority of the store can be promptly performed by the cash center 200. In addition, in the cash center 200, the information related to the second valuable medium, which has been transmitted from the valuable-medium handling machine, and the second valuable medium, which has been actually collected from the valuable-medium handling machine and brought to the cash center 200, can be compared to each other.

The invention claimed is:

1. A money handling machine comprising:

a recognition unit configured to recognize a banknote and to count the number of banknotes;

a storing unit configured to store a banknote having been recognized by the recognition unit, and a valuable medium having not been recognized by the recognition unit, the storing unit being managed by a manager having a second management authority;

an input unit having a function for enabling data and/or instructions inputted by a manager having a first management authority;

a control unit configured to perform a count/deposit process based on an instruction having been inputted through the input unit, the instructions being for performing a deposit process of a banknote, and configured to perform a valuable-medium deposit process based on an instruction having been inputted through the input unit, the instruction being for performing a deposit process of a valuable medium; and a memory unit configured to store a recognition result by the recognition unit, and date and/or instructions having been inputted through the input unit, wherein while the count/deposit process is being performed, the recognition unit recognizes a banknote having been put into the money handling machine, the storing unit stores the recognized banknote, and the memory unit stores first information related to a recognition result including the number of banknotes for each denomination, while the valuable-medium deposit process is being performed, the recognition unit does not recognize a valuable medium having been put into the money handling machine, the storing unit stores the valuable medium, and the memory unit stores second information related to the valuable medium having been inputted through the input unit, the control unit transmits the first information and the second information stored in the memory unit, distinguishably from each other, to an external apparatus under the second management authority, the external apparatus being disposed outside the money handling machine.

2. The money handling machine according to claim 1, wherein the control unit is configured to transmit the banknote recognition result by the recognition unit and information related to a total amount of banknotes and the valuable medium stored in the storing unit, distinguishably from each other, to the external apparatus.

3. The money handling machine according to claim 1, wherein the control unit is configured to transmit information related to the valuable medium having been inputted through the input unit, and information related to a total amount of banknotes and the valuable medium stored in the storing unit, distinguishably from each other, to the external apparatus.

4. The money handling machine according to claim 1, wherein the banknotes having been recognized by the recognition unit and the valuable medium having not been recognized by the recognition unit are stored in the storing unit in a mixed state.

5. The money handling machine according to claim 1, wherein the storing unit is composed of a plurality of storing portions, and the banknotes having been recognized by the recognition unit and the valuable medium having not been recognized by the recognition unit are stored in different storing portions.

6. The money handling machine according to claim 1, wherein:

a medium other than the valuable medium that is not equivalated to an amount of money is capable of being stored into the storing unit;

in storing a medium other than the banknotes having been recognized by the recognition unit into the storing unit, whether or not the medium is a medium equivalated to an amount of money is elected, and only when the medium to be stored into the storing unit is a medium equivalated to an amount of money, information related to an amount of the medium is inputted through the input unit.

7. A money handling system comprising a money handling machine configured to handle money, and an external apparatus located distinguishably from the money handling machine and communicably connected to the money handling machine, wherein:

the money handling machine including: a recognition unit configured to recognize a banknote and to count the number of banknotes; a storing unit configured to store a banknote having been recognized by the recognition unit, and a valuable medium having not been recognized by the recognition unit, the storing unit being managed by a manager having a second management authority; an input unit having a function for enabling data and/or instructions inputted by a manager having a first management authority; a control unit configured to perform a count/deposit process based on an instructions having been inputted through the input unit, the instructions being for performing a deposit process of a banknote, and configured to perform a valuable-medium deposit process based on an instruction having been inputted through the input unit, the instruction being for performing a deposit process of a valuable medium; and a memory unit configured to store a recognition result by the recognition unit, and data and/or instructions having been inputted through the input unit, wherein while the count/deposit process is being performed, the recognition unit recognizes a banknote having been put into the money handling machine, the storing unit stores the recognized banknote, and the memory unit stores first information related to a recognition result including the number of banknotes for each denomination, while the valuable-medium deposit process is being performed, the recognition unit does not recognize a valuable medium having been put into the money handling machine, the storing unit stores the valuable medium, and the memory unit stores second information related to the valuable medium having been inputted through the input unit, the control unit transmits the first information and the second information stored in the memory unit, distinguishably from each other, to the external apparatus under the second management authority, the external apparatus being disposed outside the money handling machine.

8. A money handling method in a money handling machine, the money handling machine comprising a recognition unit configured to recognize a banknote and to count the number of the banknote; a storing unit configured to store a banknote having been recognized by the recognition unit, and a valuable medium having not been recognized by the recognition unit, the storing unit being managed by a manager having a second management authority; an input unit having a function for enabling data and/or instructions inputted by a manager having a first management authority; a control unit configured to perform a count/deposit process based on an instruction having been inputted through the input unit, the instruction being for performing a deposit process of a banknote, and configured to perform a valuable-medium deposit process based on an instruction having been inputted through the input unit, the instruction being for performing a deposit process of a valuable medium; and a memory unit configured to store a recognition result by the recognition unit, and data and/or instructions having been inputted through the input unit, the method comprising:

while the count/deposit process is being performed, recognizing, by the recognition unit, a banknote having been put into the money handling machine;

storing, by the storing unit, the recognized banknote; and storing, by the memory unit, first information related to a recognition result including the number of banknotes for each denomination, while the valuable-medium deposit process is being performed, storing, by the storing unit, a valuable medium having been put into the money handling machine and having not been recognized by the recognition unit; and storing, by the memory unit, second information related to the valuable medium having been inputted through the input unit;

transmitting, by the control unit, the first information and the second information stored in the memory unit, distinguishably from each other, to an external apparatus under the second management authority, the external apparatus being disposed outside the money handling machine.

9. The money handling method according to claim 8, wherein the control unit transmits a banknote recognition result by the recognition unit and information related to a total amount of the banknotes and the valuable medium stored in the storing unit, distinguishably from each other, to the external apparatus.

10. The money handling method according to claim 8, wherein the control unit transmits information related to the valuable medium having been inputted through the input unit, and information related to a total amount of the banknotes and the valuable medium stored in the storing unit, distinguishably from each other, to the external apparatus.

11. The money handling method according to claim 8, wherein the banknotes having been recognized by the recognition unit and the valuable medium having not been recognized by the recognition unit are stored in the storing unit in a mixed state.

12. The money handling method according to claim 8, wherein the storing unit is composed of a plurality of storing portions, and the banknotes having been recognized by the recognition unit and the valuable medium having not been recognized by the recognition unit are stored in different storing portions.

* * * * *